US009941602B2

(12) United States Patent
Nakajima et al.

(10) Patent No.: US 9,941,602 B2
(45) Date of Patent: Apr. 10, 2018

(54) TERMINAL CAPABLE OF POSITIVELY SCRAPING OFF INSULATING COATING OF AN ELECTRIC WIRE

(71) Applicant: JAPAN AVIATION ELECTRONICS INDUSTRY, LIMITED, Shibuyaku, Tokyo (JP)

(72) Inventors: Hiroatsu Nakajima, Tokyo (JP); Osamu Hashiguchi, Tokyo (JP); Hiroyuki Ebihara, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/217,329

(22) Filed: Jul. 22, 2016

(65) Prior Publication Data

US 2017/0040714 A1 Feb. 9, 2017

(30) Foreign Application Priority Data

Aug. 3, 2015 (JP) ..... 2015-153248

(51) Int. Cl.
*H01R 4/24* (2006.01)
*H01R 4/26* (2006.01)
*H01R 11/20* (2006.01)

(52) U.S. Cl.
CPC ..... *H01R 4/242* (2013.01); *H01R 4/2454* (2013.01); *H01R 4/2425* (2013.01)

(58) Field of Classification Search
CPC .... H01R 4/242; H01R 4/2416; H01R 4/2454; H01R 4/2462; H01R 4/245
USPC ..... 439/395, 404
See application file for complete search history.

(56) References Cited

U.S. PATENT DOCUMENTS 4,116,522 A * 9/1978 Reynolds ..... H01R 4/2462 439/398
4,141,618 A * 2/1979 Reavis, Jr. ..... H01R 4/2441 439/406
4,212,509 A * 7/1980 Brooks ..... H01R 4/2462 439/396
4,230,391 A * 10/1980 Keglewitsch ..... H01R 4/2425 439/395
4,431,249 A * 2/1984 Frantz ..... H01R 27/02 439/404
5,683,266 A * 11/1997 Guidi ..... H01R 4/2425 439/395

(Continued)

FOREIGN PATENT DOCUMENTS

JP 63092239 A 4/1988

*Primary Examiner* — Hae Moon Hyeon
(74) *Attorney, Agent, or Firm* — Holtz, Holtz & Volek PC

(57) ABSTRACT

A terminal that is capable of positively scraping off insulation coating of an electric wire. A wire connection portion is formed with a slit. A pair of positioning portions and a pair of supporting portions are disposed with the slit of the wire connection portion therebetween. A spacing between the pair of supporting portions is smaller than a spacing between the pair of positioning portions. Each supporting portion is formed with a corner portion in an end portion thereof toward a positioning portion associated therewith. Each positioning portion is formed with a cutout in an end portion thereof toward the supporting portion. An inner surface of the cutout is continuous with a surface of each corner portion toward the positioning portion.

20 Claims, 12 Drawing Sheets

(56) References Cited

U.S. PATENT DOCUMENTS

| | | | | |
|---|---|---|---|---|
| 6,142,817 | A * | 11/2000 | Lee | H01R 13/112 439/395 |
| 6,908,331 | B2 * | 6/2005 | Brown | H01R 4/26 439/395 |
| 7,118,404 | B2 * | 10/2006 | Ploesser | H01R 4/2454 439/395 |
| 8,708,733 | B2 * | 4/2014 | Parrish | H01R 4/242 439/395 |
| 8,746,653 | B2 * | 6/2014 | Kellner | H01F 5/02 251/129.15 |
| 2009/0111311 | A1 * | 4/2009 | Weber | H01R 4/2454 439/357 |
| 2016/0072200 | A1 * | 3/2016 | Sabo | H01R 4/2425 439/395 |

* cited by examiner

TERMINAL CAPABLE OF POSITIVELY SCRAPING OFF INSULATING COATING OF AN ELECTRIC WIRE

BACKGROUND OF THE INVENTION

Field of the Invention

The invention relates to a terminal.

Description of the Related Art

Conventionally, as shown in FIG. 12, there has been known a terminal 903 to which a copper wire 902 of a coil end and a lead wire (not shown) of a generator are connected (see Japanese Laid-Open Patent Publication (Kokai) No. S63-92239).

The terminal 903 is provided with a U-shaped groove 903A for connecting the copper wire 902 of the coil end and protrusions 903B for fixing the terminal.

A groove width W1 of an innermost portion of the U-shaped groove 903A is smaller than a groove width W2 of an entrance portion of the same, and the terminal 903 is formed with stepped portions 903A1 for scraping off an insulation coating 902B of the copper wire 902. The groove width W1 of the innermost portion of the U-shaped groove 903A is smaller than an outer diameter V1 of a copper part 902A of the copper wire 902.

The copper wire 902 is connected to the terminal 903 in the following manner:

First, the copper wire 902 is inserted into an insertion groove 904A formed in a connection portion 904 of a bobbin part (not shown). A width U4 of the insertion groove 904A and an outer diameter V2 of the copper wire 902 have a relationship expressed by V2≥U4, and the copper wire 902 can be supported on a wail surface of the insertion groove 904A of the connection portion 904.

Next, the terminal 903 is inserted into an insertion groove 904C formed in the connection portion 904. An outer dimension W3 of the terminal 903 is substantially the same as a width U3 of the insertion groove 904C of the connection portion 904, and a width W4 of part of the terminal 903 including the protrusions 903B is larger than the width U3 of the insertion groove 904C of the connection portion 904 by approximately 0.1 to 1 mm. Therefore, when the terminal 903 is inserted into the insertion groove 904C of the connection portion 904, the copper wire 902 is pressed against a support base 904B located at the innermost of the insertion groove 904A of the connection portion 904, and the protrusions 903B of the terminal 903 byte into wall surfaces of the insertion groove 904C of the connection portion 904, whereby the terminal 903 is fixed in the connection portion 904. The copper wire 902 is relatively moved within the U-shaped groove 903A of the terminal 903 from the entrance toward the innermost of the U-shaped groove 903A, and hence the insulation coating 902B of the copper wire 902 is scraped off by the stepped portions 903A1 of the terminal 903, whereby the copper part 902A of the copper wire 902 is electrically and mechanically connected to the terminal 903.

Each stepped portion 903A1 of the terminal 903 has an angle substantially equal to a right angle (see FIG. 12), and hence it is supposed that the insulation coating 902B of the copper wire 902 is scraped off by the stepped portions 903A1 without any problem.

If the insulation coating 902B is thin, it is only required to reduce the difference between the groove width W1 and the groove width W2.

However, for example, assuming that the terminal 903 having the U-shaped groove 903A which is small in difference between the groove width W1 and the groove width W2 is formed by blanking a metal plate, it is impossible to stably form each stepped portion 903A1 of the terminal 903 into a desired shape, and hence it is difficult to make a sharp edge. This may make it difficult to positively scrape off the insulation coating 902B of the copper wire 902.

SUMMARY OF THE INVENTION

The present invention has been made in view of these circumstances, and an object thereof is to provide a terminal that is capable of positively scraping off insulating coating of an electric wire.

To attain the above object, the present invention provides a terminal including a wire connection portion formed with a suit for receiving an electric wire and a cutout that communicates with the slit, the wire connection portion comprising a pair of positioning portions that are disposed with the slit therebetween, and determine the position of the electric wire in a direction of a width of the slit, a pair of corner portions that are disposed with the slit therebetween, and scrape oft insulation coating of the electric wire which is positioned by the pair of positioning portions, and a pair of supporting portions that are disposed with the slit therebetween, and support a conductive portion of the electric wire from which the insulation coating has been scraped off, in a state held therebetween, wherein the corner portion is located at an end portion of the supporting portion toward the positioning portion, wherein a spacing between the pair of supporting portions is smaller than a spacing between the pair of positioning portions, and wherein an inner surface of the cutout is continuous with a surface of the corner portion toward the positioning portion.

Preferably, an angle of the corner portion is not larger than a right angle.

Preferably, the inner surface of the cutout is formed by a flat surface which is continuous with the surface of the corner portion toward the positioning portion and a curved surface which is continuous with the flat surface.

Preferably, the inner surface of the cutout is formed by a curved surface which is continuous with the surface of the corner portion toward the positioning portion and a flat surface which is continuous with the curved surface.

Preferably, the inner surface of the cutout is a curved surface which is continuous with the surface of the corner portion toward the positioning portion.

Preferably, the surface of the corner portion toward the positioning portion and the inner surface of the cutout are smoothly continuous with each other.

More preferably, the flat surface which is continuous with the surface of the corner portion toward the positioning portion and the curved surface which is continuous with the flat surface are smoothly continuous with each other.

Further preferably, the curved surface which is continuous with the surface of the corner portion toward the positioning portion and the fiat surface which is continuous with the curved surface are smoothly continuous with each other.

Preferably, the wire connection portion includes a pair of wire guiding portions that are disposed with the slit therebetween, and guide the electric wire into between the pair of positioning portions.

Preferably, the pair of supporting portions include a pair of first supporting area portions that are disposed with the slit therebetween, and are adjacent to the positioning portions, respectively, a pair of second supporting area portions that are disposed with the slit therebetween, and receive the conductive portion having passed between the pair of first supporting area portions, and a pair of third supporting area portions that are disposed with the slit therebetween, and guide the conductive portion having passed between the pair of first supporting area portions into between the pair of second supporting area portions, and wherein a spacing between the pair of second supporting area portions is smaller than a spacing between the pair of first supporting area portions.

Preferably, the wire connection portion is formed by blanking a metal plate.

According to the present invention, it is possible to provide a terminal that is capable of positively scraping off insulating coating of an electric wire.

The above and other objects, features and advantages of the present invention will become more apparent from the following detailed description taken in conjunction with the accompanying drawings.

BRIEF DESCRIPTION OP THE DRAWINGS

DETAILED DESCRIPTION OF THE PREFERRED EMBODIMENT

Figure 1:
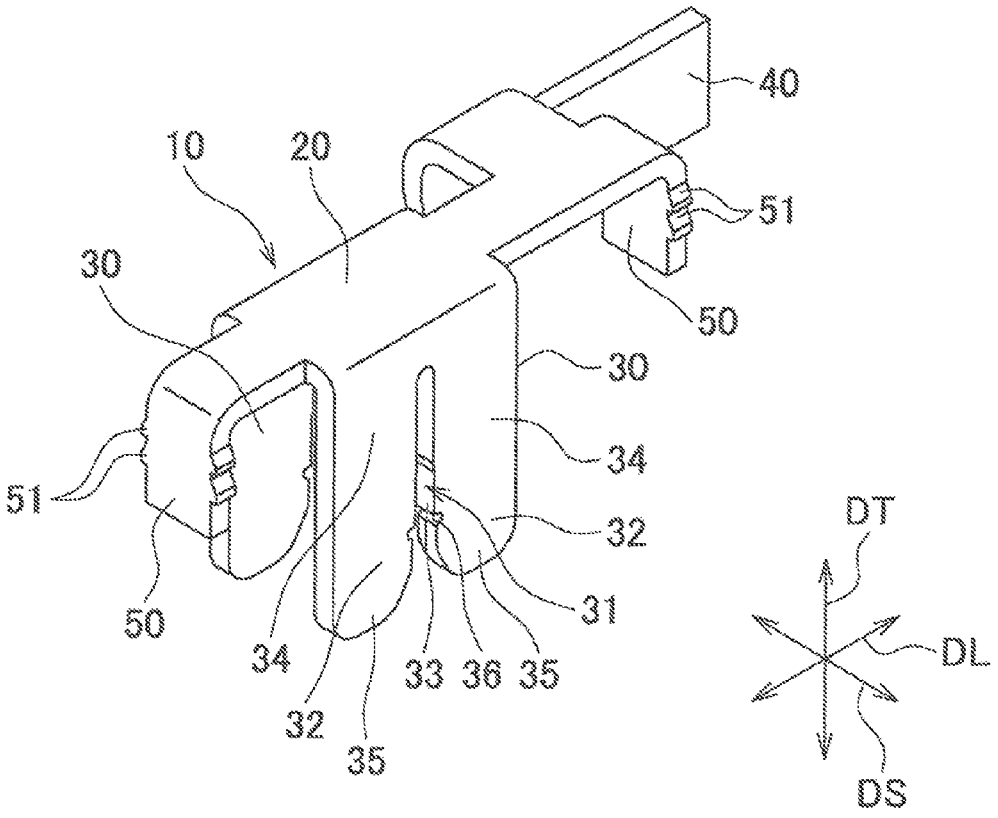
FIG. 1 is a perspective view of a terminal according to an embodiment of the present invention.
Figure 2:
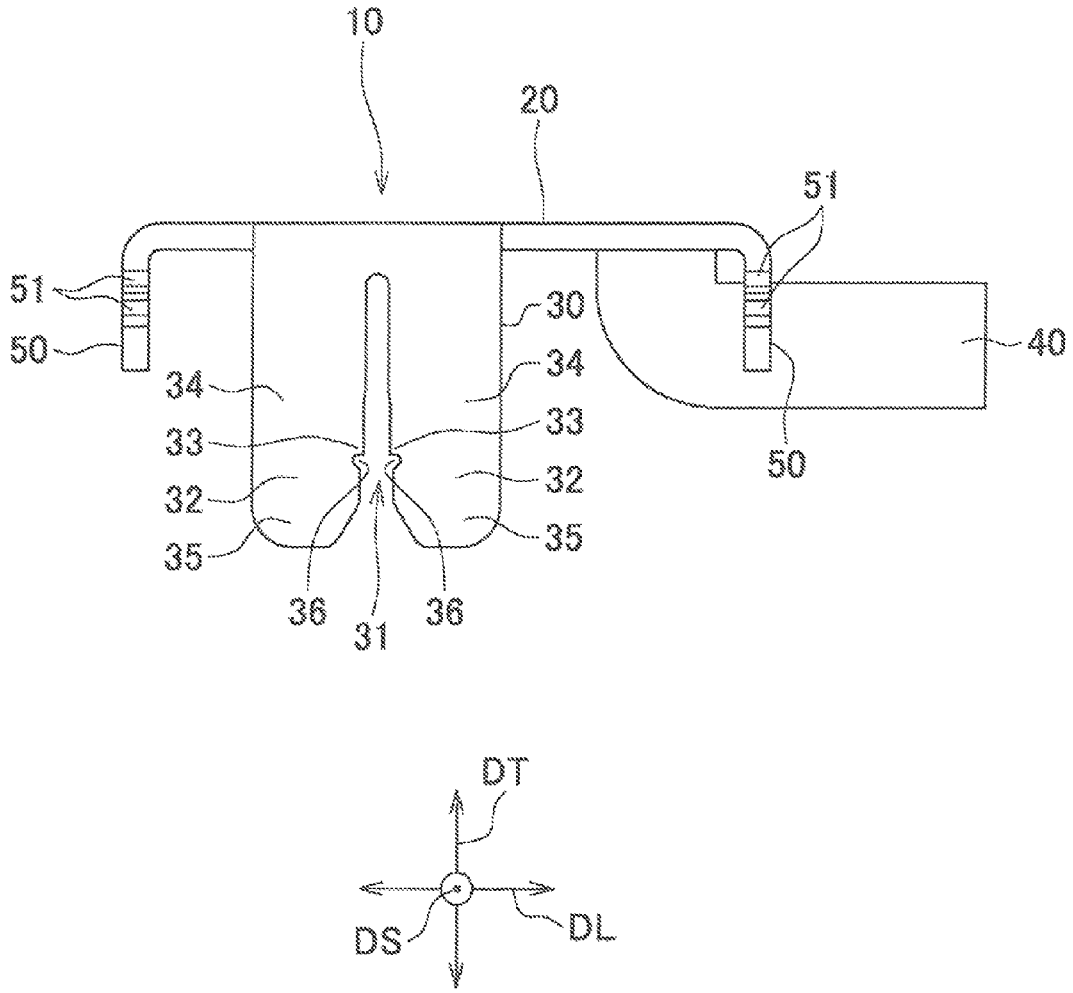
FIG. 2 is a side view of the terminal shown in FIG. 1.
Figure 3:
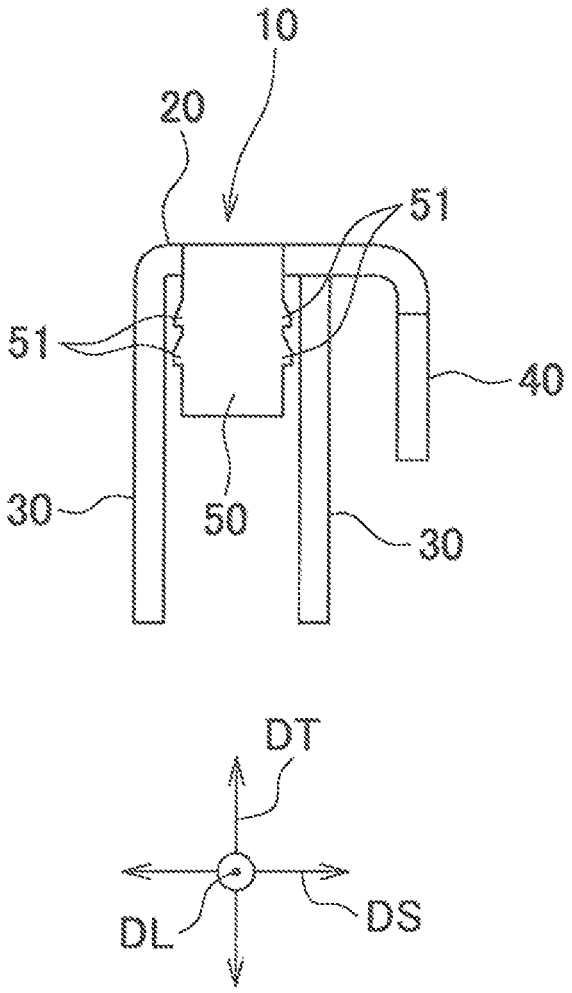
FIG. 3 is a front view of the terminal shown in FIG. 1.
Figure 4:
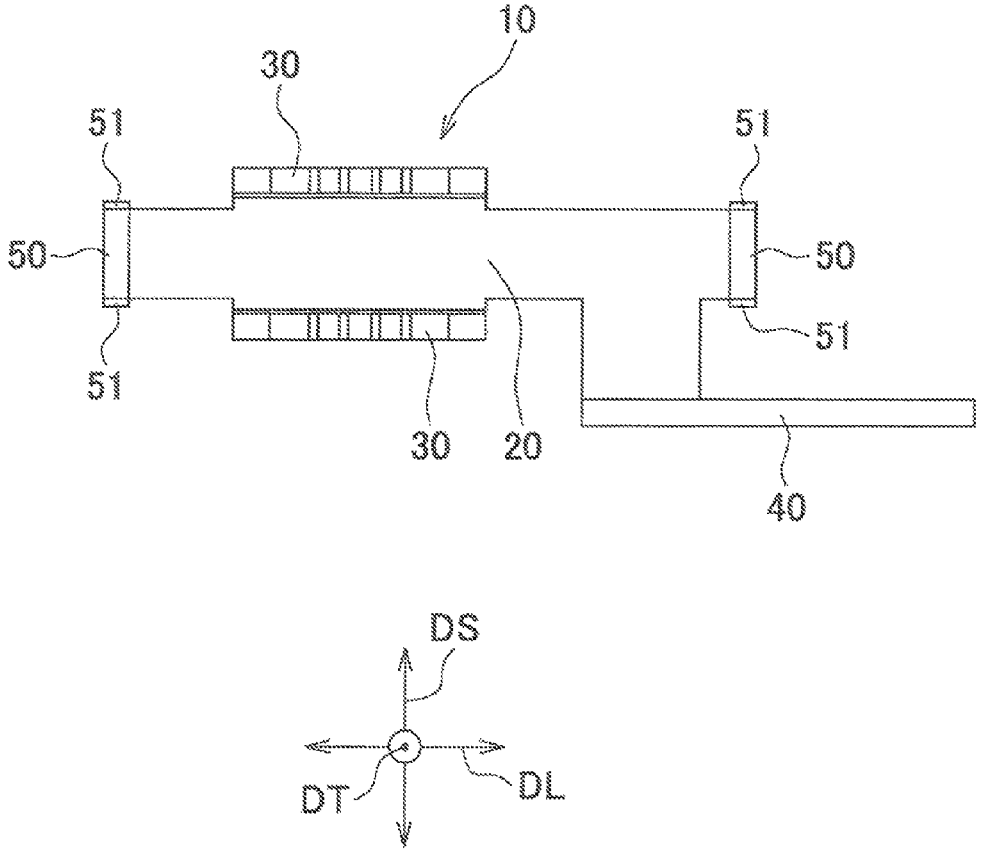
FIG. 4 is a bottom view of the terminal shown in FIG. 1.

The present invention will now be described in detail with reference to the drawings showing preferred embodiments thereof.

As shown in FIGS. 1 to 4, a terminal 10 according to an embodiment of the present invention is comprised of a terminal base 20, a pair of wire connection portions 30, a lead wire-soldering portion 40, and a pair of press-in portions 50. The terminal 10 electrically connects a lead wire, not shown, and an electric wire 70 (see FIG. 5) of a coil end.

The terminal base 20 has a rectangular plate shape.

One of the pair of press-in portions 50 is continuous with one end of the terminal base 20 in a longitudinal direction DL, and the other of the pair of press-in portions 50 is continuous with the other end of the terminal base 20 in the longitudinal direction DL. The pair of press-in portions 50 each have a rectangular plate shape. The pair of press-in portions 50 are beat at right angles to the terminal base 20, respectively, and are opposed to each other in the longitudinal direction DL of the terminal base 20. Each press-in portion 50 has a plurality of protrusions 51. The protrusions 51 are located at opposite sides of each press-in portion 50.

One of the pair of wire connection portions 30 is continuous with one side portion of the terminal base 20, and the other of the pair of wire connection portions 30 is continuous with the other side portion of the terminal base 20. The pair of wire connection portions 30 each have a rectangular plate shape. The pair of wire connection portions 30 are bent at right angles to the terminal base 20, respectively, and are opposed to each other in a lateral direction DS of the terminal base 20. Each wire connection portion 30 has a slit 31 formed in a central portion thereof, for receiving the electric wire 70. The slit 31 extends in a thickness direction DT of the terminal base 20. Surfaces of each wire connection portion 30 facing to the slit 31 except a curved surface located at the innermost of the slit 31 are flat surfaces.

The lead wire-soldering portion 40 is continuous with one of side portions of the terminal base 20. The lead wire-soldering portion 40 is an L-shaped plate. The lead wire-soldering portion 40 is bent at right angles to the terminal base 20. The lead wire-soldering portion 40 is arranged side by side with one wire connection portion 30 with a space therebetween in the longitudinal direction DL of the terminal base 20.

Figure 5:
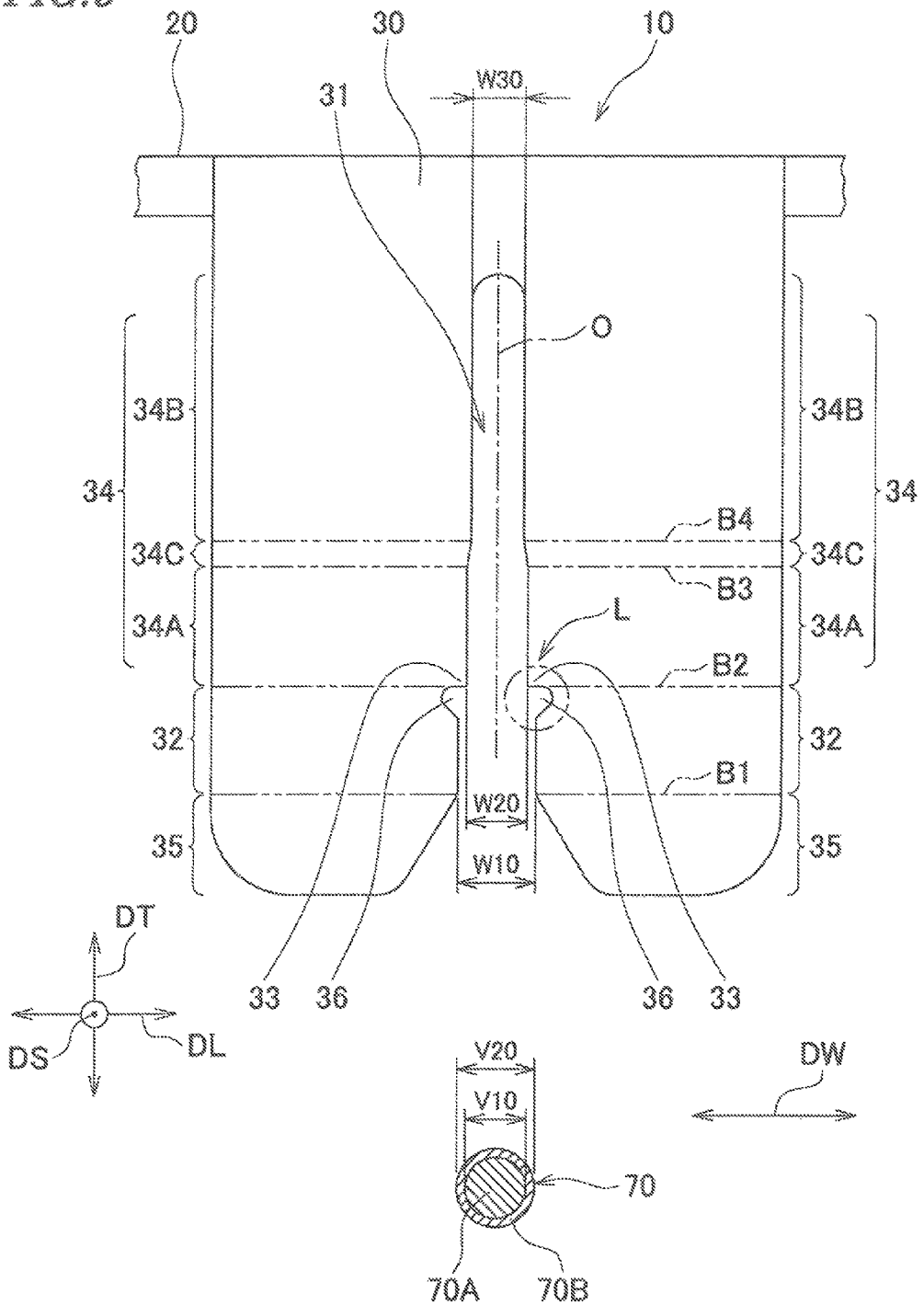
FIG. 5 is a front view of a wire connection portion of the terminal shown in FIG. 1.

As shown in FIG. 5, each wire connection portion 30 includes a pair of positioning portions 32, a pair of corner portions 33, a pair of supporting portions 34, a pair of wire guiding portions 35, etc. Note that boundary lines B1 to B4 are indicated in FIG. 5 for convenience' sake to make clear the ranges of the positioning portions 32, the supporting portions 34, and the wire guiding portions 35.

The pair of positioning portions 32 are disposed with the slit 31 therebetween. The pair of positioning portions 32 are part for positioning the electric wire 70 in a width direction DW of the slit 31. Each positioning portion 32 is an area sandwiched between the boundary line B1 and the boundary line B2. A spacing W10 between the pair of positioning portions 32 is approximately equal to an outer diameter V20 of an insulation coating 70B of the electric wire 70.

The pair of corner portions 33 are disposed with the slit 31 therebetween. The pair of corner portions 33 are portions for scraping off the insulation coating 70B of the electric wire 70 which is positioned by the pair of positioning portions 32.

The pair of supporting portions 34 are disposed with the slit 31 therebetween. The pair of supporting portions 34 are portions for holding and supporting therebetween a conductive portion 70A of the electric wire 70 from which the insulation coating 70B has been scraped off by the pair of corner portions 33. Each corner portion 33 is located on an end portion of an associated one of the supporting portions 34 toward the positioning portion 32.

The pair of supporting portions 34 include a pair of first supporting area portions 34A, a pair of second supporting area portions 34B, and a pair of third supporting area portions 34C.

The pair of first supporting area portions 34A are disposed with the slit 31 therebetween. The first supporting area portions 34A are adjacent to the positioning portions 32, respectively. Each first supporting area portion 34A is an area sandwiched between the boundary line B2 and the boundary line B3. A spacing W20 between the pair of first supporting area portions 34A has a dimension not larger than an outer diameter V10 of the conductive portion 70A of the electric wire 70. Further, the spacing W20 between the pair of first supporting area portions 34A is smaller than the spacing W10 between the pair of positioning portions 32.

The pair of second supporting area portions 34B are disposed with the slit 31 therebetween. A spacing W30 between the pair of second supporting area portions 34B is smaller than the spacing W20 between the pair of first supporting area portions 34A. The pair of second supporting area portions 34B are portions for receiving the conductive portion 70A of the electric wire 70 having passed between the pair of first supporting area portions 34A, and supporting the conductive portion 70A of the electric wire 70 in a state held more strongly therebetween than the pair of first supporting area portions 34A.

The pair of third supporting area portions 34C are disposed with the slit 31 therebetween. The third supporting area portions 34C are located between the first supporting area portions 34A and the second supporting area portions 34B, respectively. Each third supporting area portion 34C is an area sandwiched between the boundary line B3 and the boundary line B4. The pair of third supporting area portions 34C are part for guiding the conductive portion 70A of the electric wire 70 having passed between the pair of first supporting area portions 34A to the space between the pair of second supporting area portions 34B.

A spacing between the pair of third supporting area portions 34C gradually becomes smaller as it shifts from the pair of first supporting area portions 34A to the pair of second supporting area portions 34B.

The pair of wire guiding portions 35 are disposed with the slit 31 therebetween. A spacing between the pair of wire guiding portions 35 gradually becomes smaller as it shifts from the entrance toward the innermost of the slit 31. The pair of wire guiding portions 35 are portions for guiding the electric wire 70 into between the pair of positioning portions 32.

Figure 6:
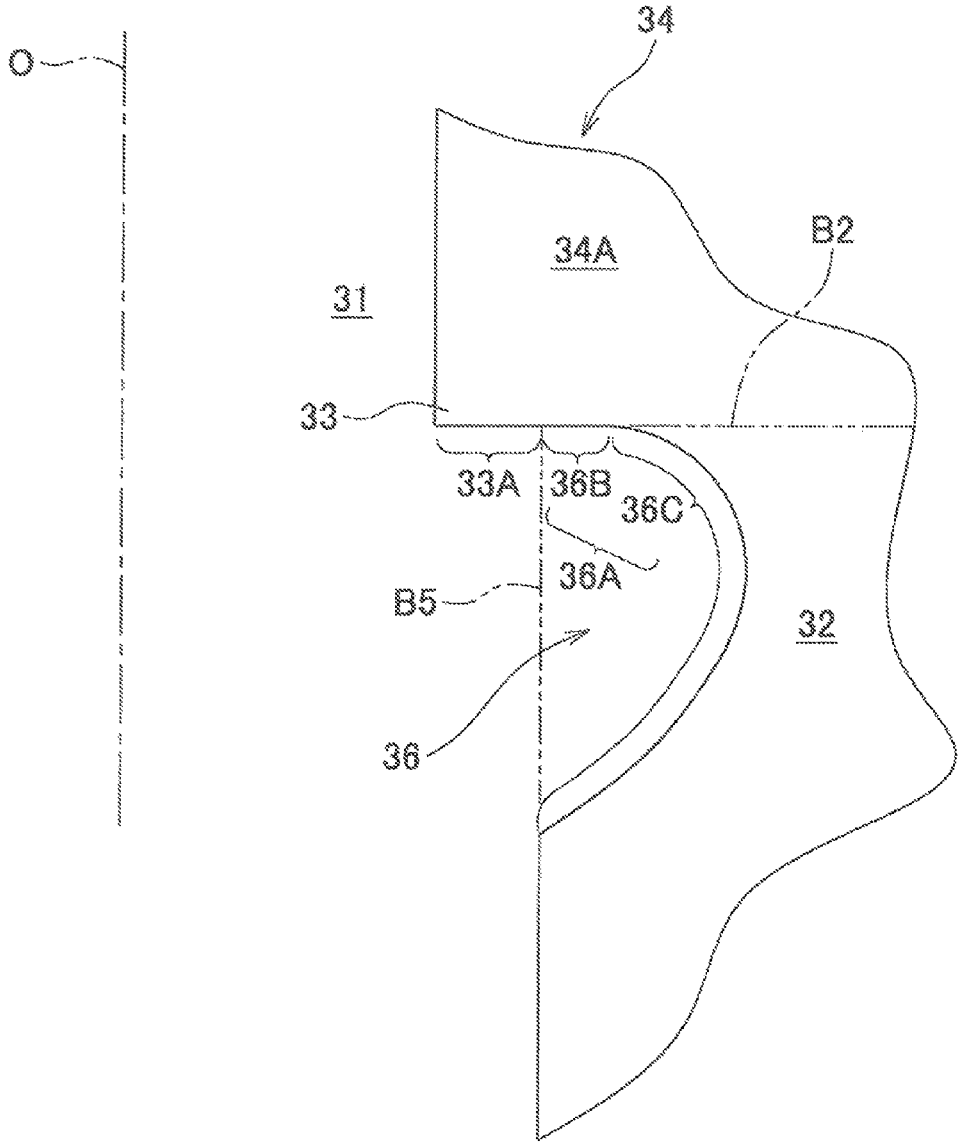
FIG. 6 is an enlarged view of part L appearing in FIG. 5.

An end portion of each positioning portion 32 toward the supporting portion 34 is formed with a cutout 36 communicating with the slit 31. As shown in FIG. 6, an inner surface 36A of the cutout 36 is smoothly continuous with a surface 33A of the corner portion 33 toward the positioning portion 32. The surface 33A of the corner portion 33 toward the positioning portion 32 is a flat surface. The inner surface 36A of the cutout 36 is formed by a flat surface 36B which is smoothly continuous with the surface 33A of the comer portion 33 toward the positioning portion 32 and a curved surface 36C which is smoothly continuous with the flat surface 36B. A boundary line B5 indicative or a boundary between the cutout 36 and the slit 31 is parallel to the central axis O of the slit 31.

Figure 7:
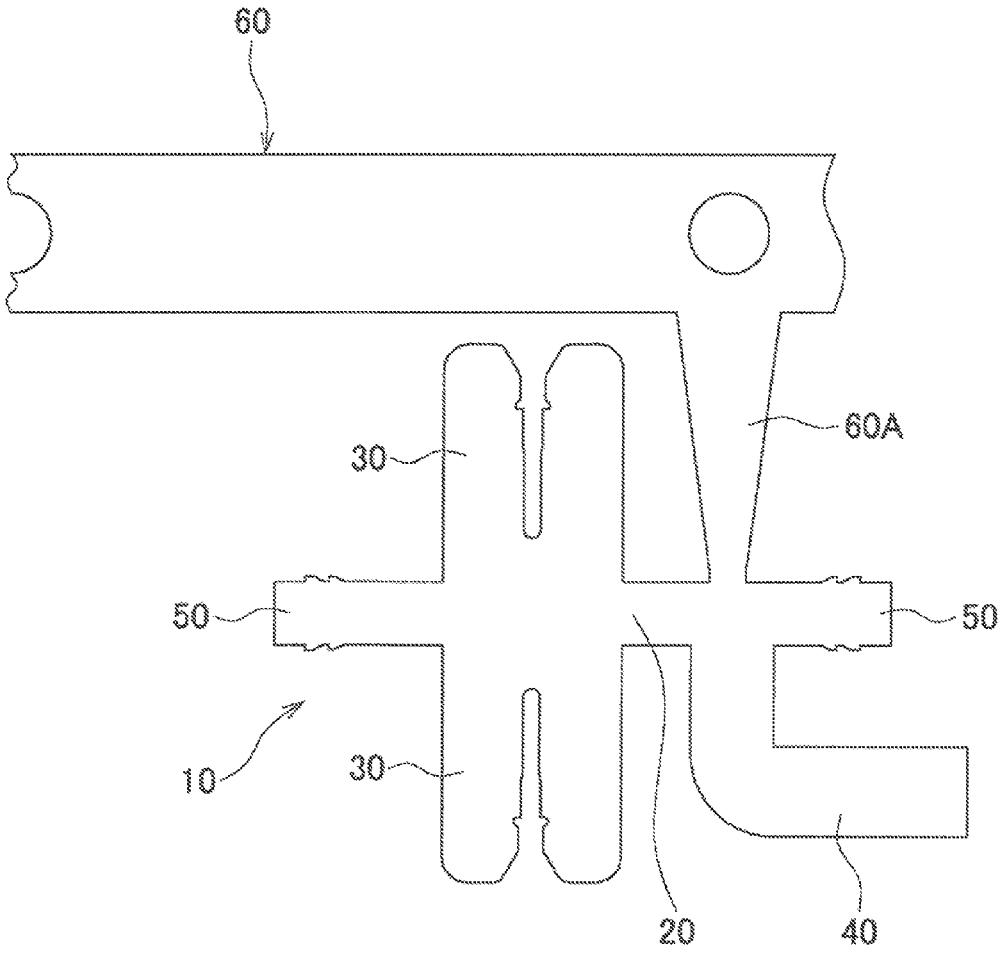
FIG. 7 is a development view of the terminal shown in FIG. 1.

To manufacture the terminal 10, first, by subjecting a metal plate (not shown) e.g. made of copper alloy to blanking, a plurality of terminals 10 each having a developed shape shown in FIG. 7 are simultaneously blanked (only one of the terminals 10 is shown in FIG. 7). At this time, the plurality of terminals 10 are connected by a carrier 60. Note that instead of blanking, the terminal 10 having a developed shape shown in FIG. 7 may be made by using a wire-cut electric discharge machining method.

The terminal base 20, the pair of wire connection portions 30, the lead wire-soldering portion 40, and the pair of press-in portions 50 are formed by blanking. Further, since the cutouts 36 communicating with the slit 31 are formed in end portions of the positioning portions 32 toward the supporting portions 34, respectively, each corner portion 33 forms a right angle. In this case, the "right angle" includes not only a right angle in a strict sense, but also an angle which is slightly larger than 90 degrees.

After blanking, each terminal 10 is subjected to bending to thereby bend the portions (the wire connection portions 30, the lead wire soldering portion 40, and the press-in portions 50) of the terminal 10.

After bending, the terminals 10 are cut off from a linking portion 60A of the carrier 60.

Thus, through the above-described process, the terminal 10 shown in FIGS. 1 to 4 is completed.

Next, a description will be given of connection between the lead wire and the electric wire 70 of the coil end, using the terminal 10.

First, lead wires are soldered to the lead wire-soldering portions 40 of the plurality of terminals 10, respectively.

Next, the press-in portions 50 of the plurality of terminals 10 are press -fitted into an inner side surface (surface toward the coil) of a ring-shaped cover to be accommodated in a motor, not shown. As a result, the plurality of terminals 10 are arranged in the cover in an annular form. The cover is for covering a ring-shaped portion of a base insulator of the motor, not shown.

After that, the cover is mounted on the ring-shaped portion of the base insulator. At this time, the electric wire 70 temporarily held by the ring-shaped portion of the base insulator is electrically and mechanically connected to the pair of wire connection portions 30 of each terminal 10.

Hereafter, a process for connecting the electric wire 70 and the pair of wire connection portions 30 of each terminal 10 will be described in detail (see FIG. 5).

First, the electric wire 70 positioned at the entrance of the slit 31 is guided into between the pair of positioning portions 32 by the wire guiding portions 35 of the pair of wire connection portions 30. The position of the electric wire 70 in the width direction DW of the slit 31 is performed by the pair of positioning portions 32.

The electric wire 70 inserted between the pair of positioning portions 32 passes between the pair of corner portions 33 and enters between the pair of first supporting area portions 34A. The spacing W20 between the pair of first supporting area portions 34A is smaller than the spacing W10 between the pair of positioning portions 32, and a difference between the spaces W20 and W10 is not smaller than the thickness of the insulation coating 70B of the electric wire 70. Further, the angle of each corner portion 33 is the right angle, and the corner portions 33 are sharp. Therefore, when the electric wire 70 passes the space between the pair of corner portions 33, the insulation coating 70B of the electric wire 70 is positively scraped off, and the conductive portion 70A of the electric wire 70 is supported by the pair of first supporting area portions 34A.

After that, the conductive portion 70A of the electric wire 70 between the pair of first supporting area portions 34A is guided by the pair of third supporting area portions 34C into between the pair of second supporting area portions 34B. Since the spacing W30 between the pair of second supporting area Portions 34B is smaller than the spacing W20 between the pair of first supporting area portions 34A, the conductive portion 70A of the electric wire 70 is supported by the pair of second supporting area portions 34B more strongly than the pair of first supporting area portions 34A. Thus, the electric wire 70 and each terminal 10 are electrically and mechanically connected to each other.

According to the present embodiment, since the cutout 36 communicating with the slit 31 is formed in the end portion of each positioning portion 32 toward the supporting portion 34, even when the difference between the spacing W10 between the pair of positioning portions 32 and the spacing W20 between the pair of first supporting area portions 34A is small, it is possible to make each corner portions 33 sharp, and thereby positively scrape off the insulation coating 70B of the electric wire 70.

Further, since the cutout 36 communicating with the slit 31 is formed in the end portion of each positioning portion 32 toward the supporting portion 34, the operation for sharpening the corner portions 33 is facilitated.

Further, the surface 33A of each corner portion 33 toward the positioning portion 32 is smoothly continuous with the inner surface 36A of the cutout 36, and hence it is possible to suppress generation of so-called burr. Similarly, the flat surface 36B and the curved surface 36C forming the inner surface 36A of the cutout 36 are smoothly continuous with each other, and hence it is possible to suppress generation of burr, Further, since each supporting portion 34 is formed by the first supporting area portion 34A, the second supporting area portion 34B, and the third supporting area portion 34C, and the spacing W20 between the pair of first supporting area portions 34A, the spacing W30 between the pair of second supporting area portions 34B, and the spacing between the pair of third supporting area portions 34C are all made different from each other, it is possible to enhance contact stability between the electric wire 70 and the terminal 10, compared with a wire connection portion (not shown) in which each supporting portion 34 is formed only by the first supporting area portion 34A, and the spacing between the pair of first supporting portions 34 is fixed.

Further, since the wire connection portion 30 includes the pair of wire guiding portions 35, it is possible to easily insert the electric wire 70 into the slit 31.

Further, since the surfaces of each wire connection portion 30 facing to the slit 31 except the curved surface located at the innermost of the slit 31 are flat surfaces, it is possible to easily manufacture a mold for blanking processing for forming the slit 31.

Next, a description will be given of first to fourth variations of the embodiment shown in FIG. 1 with reference to FIGS. 8 to 11.

The first to fourth variations differ from the embodiment shown in FIG. 1 in the shapes of the corner portion and the cutout. The same portions as those of the embodiment shown in FIG. 1 are denoted by the same reference numerals, and description thereof is omitted. The following description will be given only of different points from the embodiment shown in FIG. 1.

Figure 8:
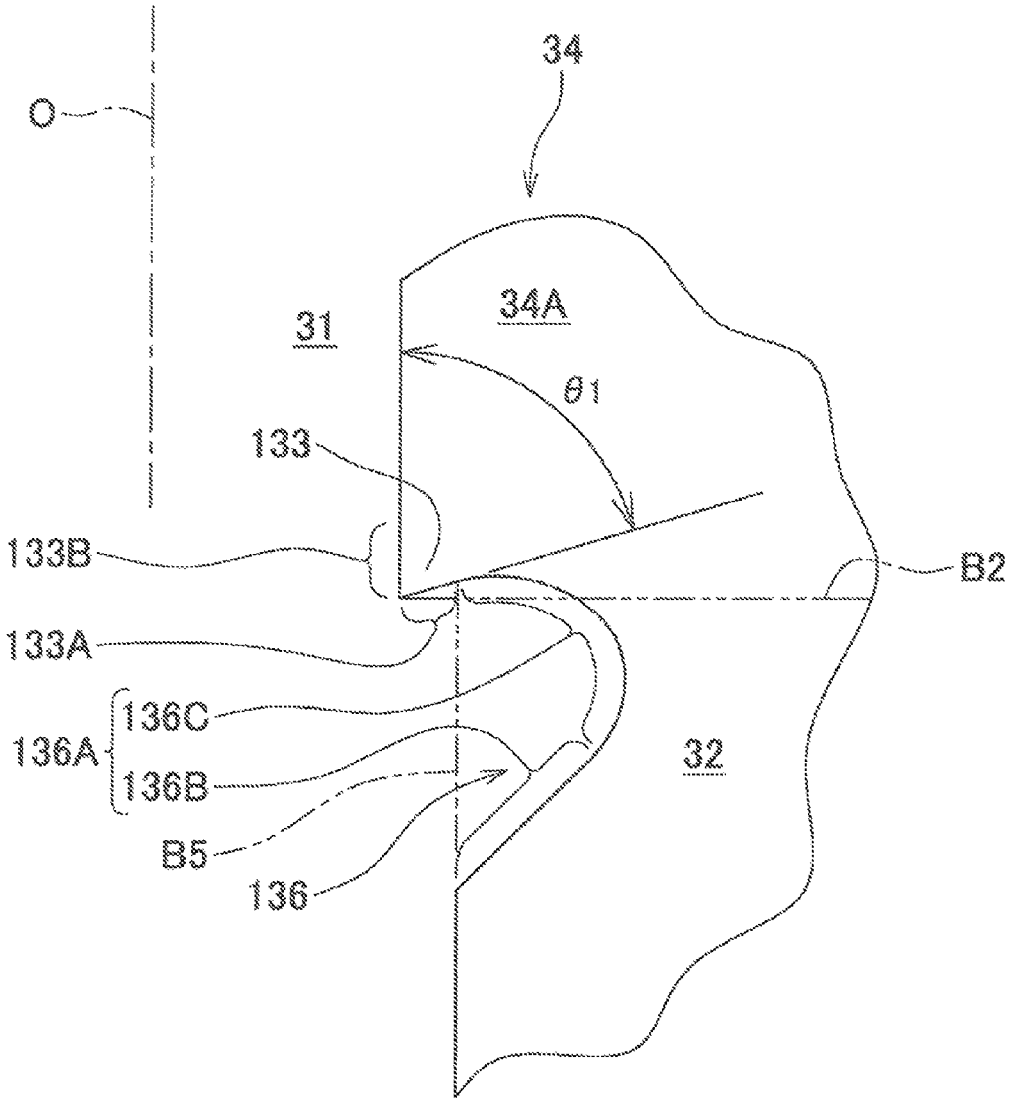
FIG. 8 is an enlarged view of a corner portion and a cutout of a first variation of the terminal shown in FIG. 1.

Although in the embodiment shown in FIG. 1, the angle of the corner portion 33 is a right angle, in the first variation shown in FIG. 8, an angle θ1 of a corner portion 133 is smaller than 90°. A surface 133A of the corner portion 133 toward the positioning portion 32 is a flat surface.

An inner surface 136A of a cutout 136 is formed by a curved surface 136C and a flat surface 136B. The curved surface 136C is smoothly continuous with the surface 133A of the corner portion 133 toward the positioning portion 32. The flat surface 136B is smoothly continuous with the curved surface 136C. The angle θ1 of the corner portion 133 is an angle formed by a surface 133B of the corner portion 133, which is parallel to the central axis O of the slit 31 (the surface 133B corresponds to part of the surface of the first supporting area portion 34A parallel to the central axis O of the slit 31), and the surface 133A of the corner portion 133 toward the positioning portion 32.

Although in he embodiment shown in FIG. 1, the cutout 36 is formed in the end portion of the positioning portion 32 toward the supporting portion 34, in the first variation, the cutout 136 extends to the end portion of the supporting portion 34 toward the positioning portion 32.

According to the first variation, since the angle θ1 of the corner portion 133 is smaller than 90°, it is possible to more positively scrape off the insulation coating 70B of the electric wire 70.

Figure 9:
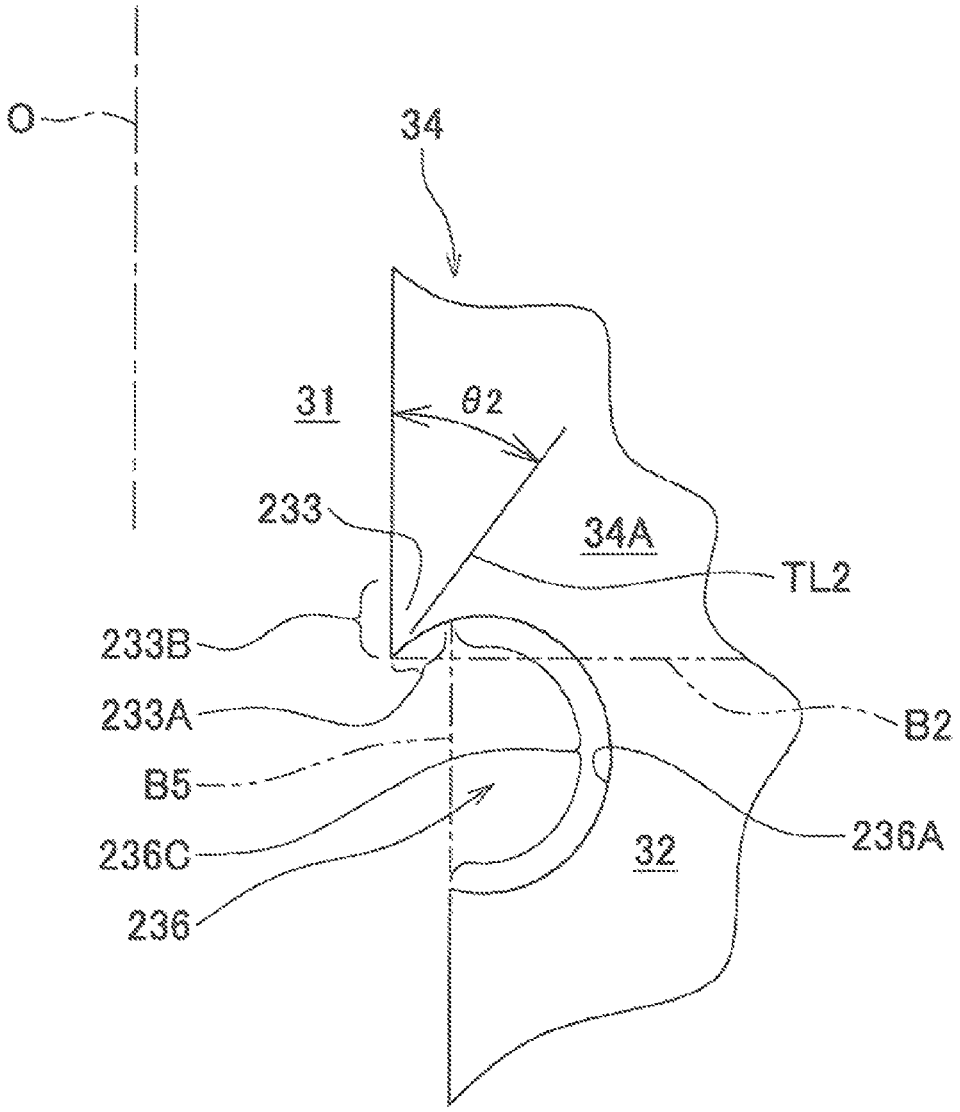
FIG. 9 is an enlarged view of a corner portion and a cutout of a second variation of the terminal shown in FIG. 1.

In the second variation shown in FIG. 9, similarly to the first variation, an angle θ2 of a corner portion 233 is smaller than 90°. A surface 233A of the corner portion 233 toward the positioning portion 32 is a curved surface.

An inner surface 236A of a cutout 236 is formed only by a curved surface 236C. The curved surface 236C is smoothly continuous with the surface 233A of the corner portion 233 toward the positioning portion 32. The angle θ2 of the corner portion 233 is an angle formed by a surface 233B of the corner portion 233, which is parallel to the central axis O of the slit 31 (the surface 233B corresponds to part of the surface of the first supporting area portion 34A parallel to the central axis O of the slit 31), and a tangential line TL2 of the surface 233A of the corner portion 233 toward the positioning portion 32.

According to the second variation, it is possible to obtain the same advantageous effects as provided by the first variation.

Figure 10:
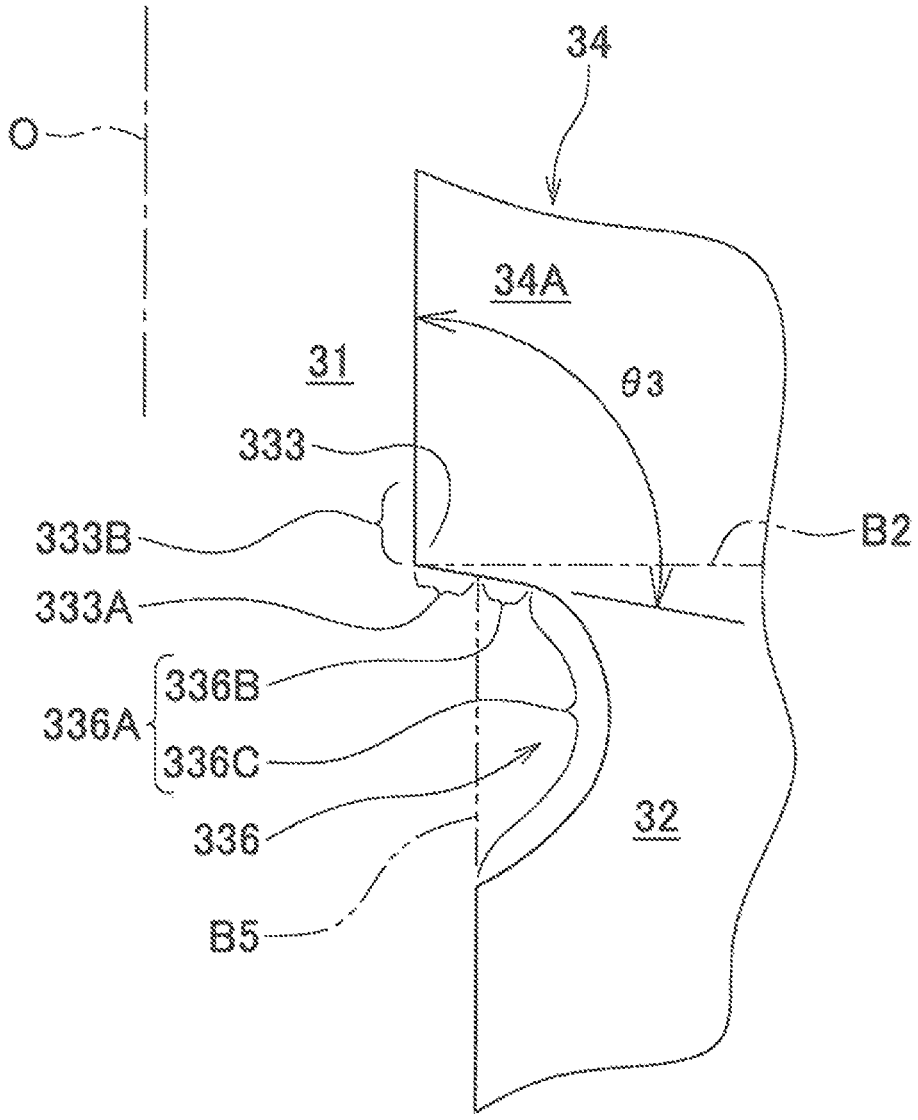
FIG. 10 is an enlarged view of a corner portion and a cutout of a third variation of the terminal shown in FIG. 1.

In the third variation shown in FIG. 10, an angle θ3 of a corner portion 333 is larger than 90°. A surface 333A of the corner portion 333 toward the positioning portion 32 is a flat surface.

An inner surface 336A of a cutout 336 is formed by a flat surface 336B and a curved surface 336C. The flat surface 336B is smoothly continuous with the surface 333A of the corner portion 333 toward the positioning portion 32. The curved surface 336C is smoothly continuous with the flat surface 336B. The angle θ3 of the corner portion 333 is an angle formed by a surface 333B of the corner portion 333, which is parallel to the central axis O of the slit 31 (the surface 333B corresponds to part of the surface of the first supporting area portion 34A parallel to the central axis O of the slit 31), and the surface 333A of the corner portion 333 toward the positioning portion 32.

According to the third variation, it is possible to obtain the same advantageous effects as provided by the embodiment shown in FIG. 1.

Figure 11:
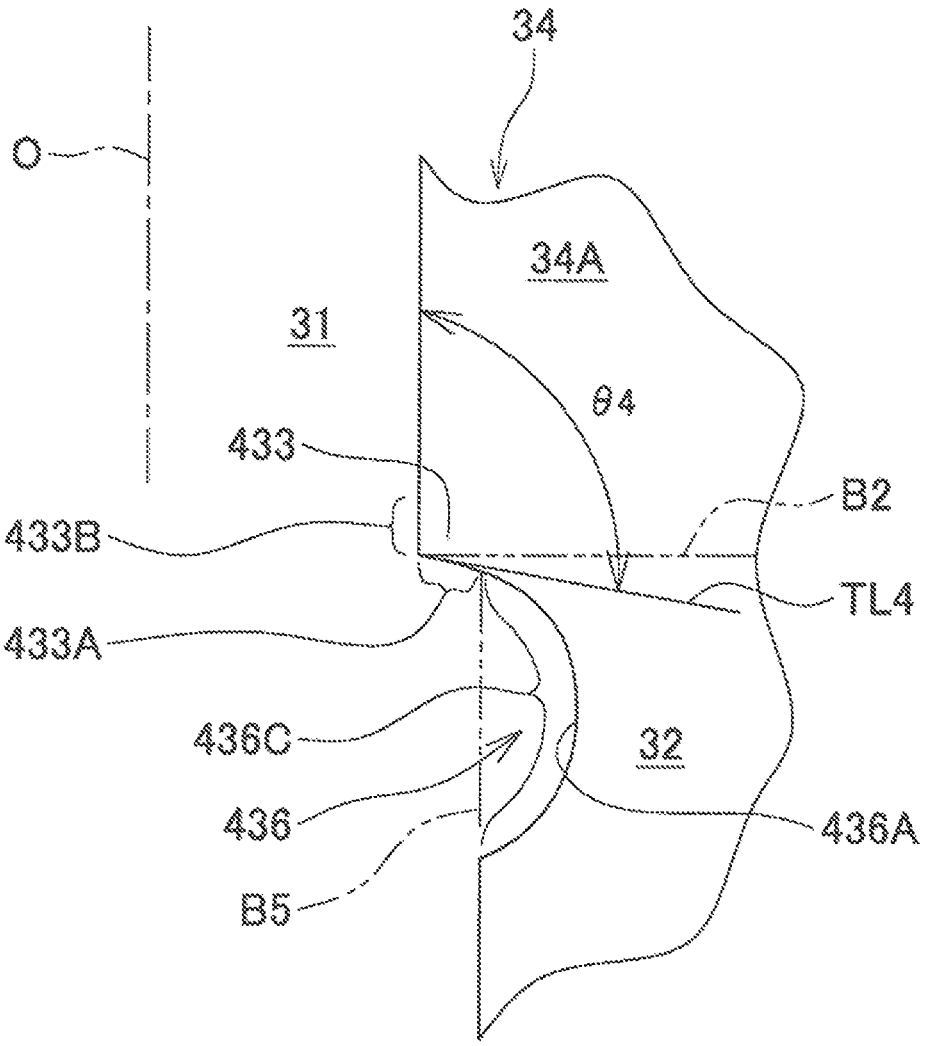
FIG. 11 is an enlarged view of a corner portion and a cutout of a fourth variation of the terminal shown in FIG. 1.
Figure 12:
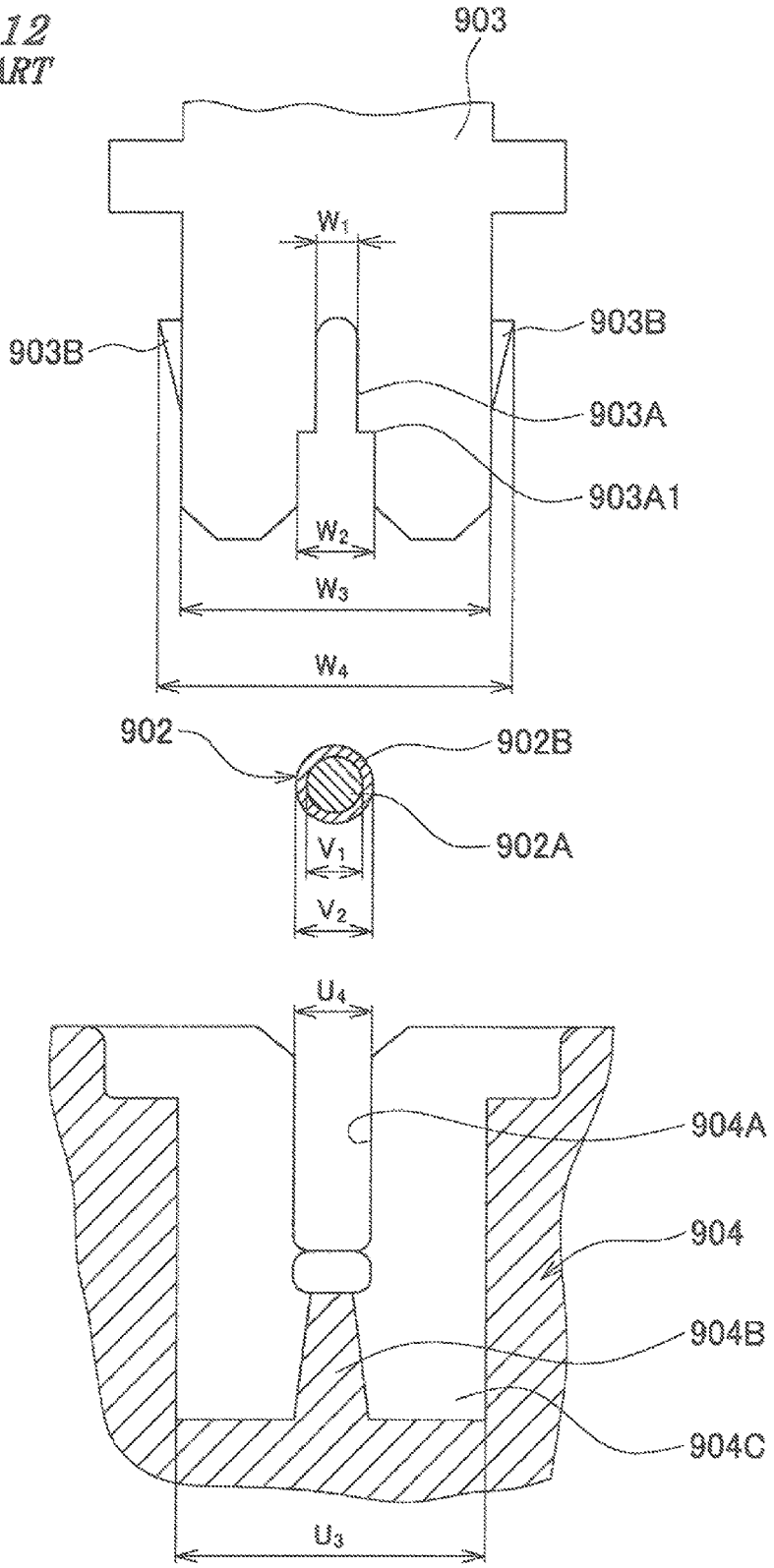
FIG. 12 PRIOR ART
FIG. 12 is an enlarged vertical cross-sectional view of a conventional terminal and a connection portion.

In the fourth variation shown in FIG. 11, an angle θ4 of a corner portion 433 is larger than 90°. A surface 433A of the corner portion 433 toward the positioning portion 32 is a curved surface.

An inner surface 436A of a cutout 436 is formed only by a curved surface 436C. The curved surface 436C is smoothly continuous with the surface 433A of the corner portion 433 toward the positioning portion 32. The angle θ4 of the corner portion 433 is an angle formed by a surface 433B of the corner portion 433, which is parallel to the central axis O of the slit 31 (the surface 433B corresponds to part of the surface of the first supporting area portion 34A parallel to the central axis O of the slit 31), and a tangential line TL4 of the surface 433A of the corner portion 433 toward the positioning portion 32.

According to the fourth variation, it is possible to obtain the same advantageous effects as provided by the third variation.

Note that although in the above-described embodiment and variations, the wire connection portion 30 includes the wire guiding portions 35, the wire guiding portions 35 are not necessarily required.

Furthers although in the above-described embodiment and variations, the spacing W20 between the pair of first supporting area portions 34A, the spacing W30 between the pair of second supporting area portions 34B, and the spacing between the pair of third supporting area portions 34C are all made different from each other, the spacing between the pair of supporting portions 34 may be made fixed without dividing the supporting portion 34 into three areas, or the spacing between the pair of supporting portions 34 may be gradually reduced toward the innermost of the slit 31.

Although in the above-described embodiment and variations, the terminal 10 is used for connection between the electric wire 70 of a coil end of the motor and the lead wire, this is not limitative, but the terminal according to the present invention may be used e.g. as a contact of a connector.

Further, although in the above-described embodiment and variations, the surfaces 33A, 133A, 233A, 333A, and 433A of the corner portions 33, 133, 233, 333, and 433, toward the positioning portion 32, are smoothly continuous with the inner surfaces 36A, 136A, 236A, 336A, and 436A of the cutouts 36, 136, 236, 336, and 436, respectively, these surfaces are not necessarily required to be smoothly continuous with each other. Similarly, although the flat surfaces 36B, 136B, and 336B, and the curved surfaces 36C, 136C, and 336C, forming the inner surfaces 36A, 136A, and 336A of the cutouts 36, 136, and 336, respectively, are smoothly continuous with each other, respectively, these surfaces are not necessarily required to be smoothly continuous with each other.

Note that the electric wire is not limited to an electric wire having the insulation coating 70B which is an insulation coating film, such as an enamel wire, but an electric wire having the insulating coating part 70B made e.g. of resin is included.

It is further understood by those skilled in the art that the foregoing are the preferred embodiments of the present invention, and that various changes and modification may be made thereto without departing from the spirit and scope thereof.

What is claimed is:

1. A terminal comprising:

a wire connection portion formed with a slit for receiving an electric wire; and a cutout that communicates with the slit, wherein the wire connection portion comprises:

a pair of positioning portions that are disposed with the slit therebetween, and determine the position of the electric wire in a direction of a width of the slit;

a pair of corner portions that are disposed with the slit therebetween, and scrape off insulation coating of the electric wire which is positioned by the pair of positioning portions; and a pair of supporting portions that are disposed with the slit therebetween, and support a conductive portion of the electric wire from which the insulation coating has been scraped off, in a state held therebetween, wherein the corner portion is located at an end portion of the supporting portion toward the positioning portion, wherein a spacing between the pair of supporting portions is smaller than a spacing between the pair of positioning portions, and wherein an inner surface of the cutout is continuous with a surface of the corner portion toward the positioning portion.

2. The terminal according to claim 1, wherein an angle of the corner portion is not larger than a right angle.

3. The terminal according to claim 1, wherein the inner surface of the cutout is formed by a flat surface which is continuous with the surface of the corner portion toward the positioning portion and a curved surface which is continuous with the flat surface.

4. The terminal according to claim 2, wherein the inner surface of the cutout is formed by a flat surface which is continuous with the surface of the corner portion toward the positioning portion and a curved surface which is continuous with the flat surface.

5. The terminal according to claim 1, wherein the inner surface of the cutout is formed by a curved surface which is continuous with the surface of the corner portion toward the positioning portion and a flat surface which is continuous with the curved surface.

6. The terminal according to claim 2, wherein the inner surface of the cutout is formed by a curved surface which is continuous with the surface of the corner portion toward the positioning portion and a flat surface which is continuous with the curved surface.

7. The terminal according to claim 1, wherein the inner surface of the cutout is a curved surface which is continuous with the surface of the corner portion toward the positioning portion.

8. The terminal according to claim 2, wherein the inner surface of the cutout is a curved surface which is continuous with the surface of the corner portion toward the positioning portion.

9. The terminal according to claim 1, wherein the surface of the corner portion toward the positioning portion and the inner surface of the cutout are smoothly continuous with each other.

10. The terminal according to claim 2, wherein the surface of the corner portion toward the positioning portion and the inner surface of the cutout are smoothly continuous with each other.

11. The terminal according to claim 3, wherein the flat surface which is continuous with the surface of the corner portion toward the positioning portion and the curved surface which is continuous with the flat surface are smoothly continuous with each other.

12. The terminal according to claim 4, wherein the flat surface which is continuous with the surface of the corner portion toward the positioning portion and the curved surface which is continuous with the flat surface are smoothly continuous with each other.

13. The terminal according to claim 5, wherein the curved surface which is continuous with the surface of the corner portion toward the positioning portion and the flat surface which is continuous with the curved surface are smoothly continuous with each other.

14. The terminal according to claim 6, wherein the curved surface which is continuous with the surface of the corner portion toward the positioning portion and the flat surface which is continuous with the curved surface are smoothly continuous with each other.

15. The terminal according to claim 1, wherein the wire connection portion includes a pair of wire guiding portions that are disposed with the slit therebetween, and guide the electric wire into between the pair of positioning portions.

16. The terminal according to claim 2, wherein the wire connection portion includes a pair of wire guiding portions that are disposed with the slit therebetween, and guide the electric wire into between the pair of positioning portions.

17. The terminal according to claim 1, wherein said pair of supporting portions include:

a pair of first supporting area portions that are disposed with the slit therebetween, and are adjacent to the positioning portions, respectively;

a pair of second supporting area portions that are disposed with the slit therebetween, and receive the conductive portion having passed between the pair of first supporting area portions; and a pair of third supporting area portions that are disposed with the slit therebetween, and guide the conductive portion having passed between the pair of first supporting area portions into between the pair of second supporting area portions, and wherein a spacing between the pair of second supporting area portions is smaller than a spacing between the pair of first supporting area portions.

18. The terminal according to claim 2, wherein said pair of supporting portions include:

a pair of first supporting area portions that are disposed with the slit therebetween, and are adjacent to the positioning portions, respectively;

a pair of second supporting area portions that are disposed with the slit therebetween, and receive the conductive portion having passed between the pair of first supporting area portions; and a pair of third supporting area portions that are disposed with the slit therebetween, and guide the conductive portion having passed between the pair of first supporting area portions into between the pair of second supporting area portions, and wherein a spacing between the pair of second supporting area portions is smaller than a spacing between the pair of first supporting area portions.

19. The terminal according to claim 1, wherein the wire connection portion is formed by blanking a metal plate.

20. The terminal according to claim 2, wherein the wire connection portion is formed by blanking a metal plate.

* * * * *